US006619017B2

(12) United States Patent
Franzaroli

(10) Patent No.: US 6,619,017 B2
(45) **Date of Patent: *Sep. 16, 2003**

(54) APPARATUS AND METHOD FOR CONVEYING ITEMS

(75) Inventor: Massimo Franzaroli, Castel Maggiore (IT)

(73) Assignee: Pulsar S.r.l., Castel Maggiore (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/509,042

(22) PCT Filed: Jul. 21, 1999

(86) PCT No.: PCT/IB99/01303

§ 371 (c)(1),
(2), (4) Date: Mar. 21, 2000

(87) PCT Pub. No.: WO00/05138

PCT Pub. Date: Feb. 3, 2000

(65) Prior Publication Data

US 2002/0108353 A1 Aug. 15, 2002

(30) Foreign Application Priority Data

Jul. 24, 1998 (IT) ..... B098A0461
Apr. 1, 1999 (IT) ..... B099A0153

(51) Int. Cl.[7] ..... B65B 63/00

(52) U.S. Cl. ..... 53/435; 53/147; 53/513; 198/419.2; 198/427

(58) Field of Search ..... 198/369.2, 426, 198/427, 435, 437, 418.7, 419.2; 53/435, 513, 153, 147

(56) References Cited

U.S. PATENT DOCUMENTS

| | | | | |
|---|---|---|---|---|
| 1,998,066 | A | 4/1935 | Anderson | |
| 3,455,085 | A | 7/1969 | McIntyre | 198/435 X |
| 3,822,006 | A | 7/1974 | Shuttleworth | 198/427 |
| 4,124,967 | A | 11/1978 | Beer et al. | |
| 4,360,098 | A | 11/1982 | Nordstrom | 198/419.2 X |
| 4,590,743 | A | 5/1986 | Hardage | 53/446 |
| 4,690,269 | A | 9/1987 | Takao | 198/419.2 |
| 4,724,946 | A | 2/1988 | Cinotti | 198/419.2 |
| 4,868,759 | A | 9/1989 | Ross et al. | |

(List continued on next page.)

FOREIGN PATENT DOCUMENTS

| | | | |
|---|---|---|---|
| EP | 0 403 079 | 12/1990 | |
| EP | 0 614 814 A1 | 9/1994 | |
| EP | 0 654 408 | 5/1995 | |
| EP | 0 654 429 | 5/1995 | |
| EP | 0 825 502 A1 | 2/1998 | |
| GB | 2227217 | 7/1990 | 198/419.2 |

*Primary Examiner*—Eugene Kim
(74) *Attorney, Agent, or Firm*—Young & Thompson

(57) ABSTRACT

Apparatus and method for conveying items (P), comprising a line for transporting said items (P) from a machine (12) for working said items situated upstream, which advances and transfers to the line (15) said items (P) at a predetermined speed (V0), to a utilization situated downstream. At least in the initial part (15') of said conveying line downstream of said working machine (12), the speed of advance (V1) of said items is maintained substantially equal to the speed of advance and transfer (V0) of said working machine situated upstream (12). It is further provided that, in order to carry longitudinally said items from said upstream machine to said downstream machine, said items are advanced in longitudinal groups or trains of items, such that, in each group or train of items, said items are longitudinally approached to each other.

42 Claims, 7 Drawing Sheets

U.S. PATENT DOCUMENTS

| | | | | |
|---|---|---|---|---|
| 4,924,657 | A | | 5/1990 | Berti et al. |
| 4,939,888 | A | * | 7/1990 | Katz et al. |
| 5,018,336 | A | * | 5/1991 | Mengotti et al. |
| 5,078,255 | A | | 1/1992 | Haley ..... 198/358 |
| 5,092,448 | A | | 3/1992 | Cinotti |
| 5,175,981 | A | | 1/1993 | Gombos et al. |
| 5,433,063 | A | | 7/1995 | Kovacs et al. |
| 5,689,942 | A | | 11/1997 | Suga |
| 5,706,627 | A | | 1/1998 | Kirka et al. |
| 5,809,738 | A | | 9/1998 | Stephens et al. |
| 5,864,484 | A | | 1/1999 | Harding |
| 5,893,259 | A | | 4/1999 | Posge |
| 5,909,796 | A | | 6/1999 | Soldavini ..... 198/435 X |
| 6,021,890 | A | | 2/2000 | Focke et al. |
| 6,317,643 | B1 | | 11/2001 | Dmochowski |
| 6,374,580 | B1 | | 4/2002 | Kujubu et al. |

* cited by examiner

APPARATUS AND METHOD FOR CONVEYING ITEMS

TECHNICAL FIELD

The present invention relates to a method and an apparatus for conveying items.

Said items being preferably, but not exclusively, in the form of rolls with substantially cylindrical shape obtained by transversely cutting a single body or elongated stick and having a respective longitudinal axis, which are advanced along a longitudinal path of advance, preferably, with its own axis oriented according to the direction of advance.

Preferably, but not exclusively, such items are in the form of rolls of paper, plastic, metallic, or similar material destined mainly to household use, for instance rolls of toilet paper, absorbing paper, plastic film or aluminium foil or others for wrapping food products and other items.

The present conveying apparatus is positioned between a working machine situated upstream, such as a machine for cutting and separating into items from said stick or elongated body, and one or more machines for working said items, such as machines for packing said items into respective packaging containers.

BACKGROUND ART

In the industry, there are machines for cutting and separating and for packing rolls, both operating at great speed.

Currently, to transport said items from said upstream machine to said downstream packaging machines, the items or rolls exiting the upstream working machine are accelerated and mutually distanced, mainly in order to create, between an item and the other, a space suitable for the performance of operations to distribute the items onto the different secondary lines of the apparatus.

To provide for said operations for distributing the items, the conveyed items are therefore subjected to stops, which serve to re-aggregate the previously detached items, followed by abrupt accelerations, which cause the items to reach high speeds, and which are effected mainly in order to attempt to recover at least part of the time wasted during said stops.

Such a traditional manner of operating on the items, however, presents numerous drawbacks.

A first drawback concerns the damage, consumption and wear whereto the items are subjected, and consequently also the conveyor belts that transport them and the related guides. Such consumption and wear are caused by the high rubbing stresses between the items and the means for transporting them, stresses whose main cause is the high levels of acceleration and speed reached in said known systems.

Such damage to the rolls is aggravated even further by the locking action provided by mechanical assemblies for stopping the rolls used in known conveying lines.

Another drawback concerns the upsets whereto a certain number of such conveyed items are subjected, especially those presenting modest length, again due to such excessive accelerations and speeds. In order to overcome such drawbacks, the presence of a certain number of personnel assigned to intervene to remove the upset items from the line becomes necessary. Such removal actions, however, cannot always be timely, so in spite of them the items cause clogging along the line, resulting in consequent stops of the line itself, with the deriving efficiency losses and slow average speeds of advance of the products.

In particular, in such known conveying apparatus, it is also common for the items produced by said cutting machines to be picked up by conveyor belts that generally travel at higher speed than that of the transferring means of said cutting machine and come to be mutually distanced from the initial phases of the conveying operation.

It has been observed that such a distancing of the items is a cause for the upset of the items themselves along the conveying line.

A further negative aspect also stems from an excessive use of motive force necessary to subject the products to such high levels of speed and acceleration, whereby it is attempted to overcome the normally provided stops of the items themselves or the stops caused by the upsetting of items along said line.

DISCLOSURE OF INVENTION

According to the present invention, a method is provided for conveying items according to claim 1. In particular, a method is provided for conveying items by means of a conveying apparatus comprising a line for conveying said items from a machine for working said items situated upstream, which advances and transfers to the line said items at a predetermined speed, to a utilisation situated downstream; characterised in that, at least in the initial part of said conveying line downstream of the working machine, the speed of advance of said items is maintained substantially equal to the speed of advance and transfer of said working machine situated upstream.

In this way it is possible to maintain, at least in the initial part of the conveying apparatus, a conveying speed that is not excessively high, allowing to obtain sufficiently low consumption and wear to the items and the belt. Said speed being at the same time sufficiently high to attain a considerable average conveying speed.

The present invention enables to avoid successively accelerating and stopping the items, as was instead the case with prior art apparatuses.

Moreover, especially if short items are to be conveyed, the risk of upsetting them along the line is minimised, avoiding to the utmost extent the need for interventions on the part of the personnel.

In short, a considerable production—meant as quantities delivered per unit of time—is obtained, greater than the one obtained with prior art apparatuses.

Moreover, a considerable structural and functional simplification of the present apparatus with respect to known apparatuses is obtained, eliminating, among other things, the presence of dedicated stopping and accelerating units.

A lower consumption of motive power with respect to known devices is also achieved.

According to a further aspect, a method is provided for conveying items, said items being advanced along a longitudinal path of advance starting from a machine for working said items situated upstream at least to a machine for treating said items situated downstream, characterised in that, to carry longitudinally said items from said upstream machine to said downstream machine, said items are advanced in longitudinal groups or trains of items; and in that, in each group or train of items, said items are longitudinally approached to each other.

Since said items are to be conveyed by being maintained longitudinally grouped together, in such away that the distance between adjacent items is such that if an item rotates or is upset, it comes in contact with an item of said group that is adjacent thereto, it is possible to prevent said upsets of the items from occurring. Hence one avoids, on one hand, the need for intervention on the personnel's part and, on the other hand, any stops to the line that feeds the items. In short, a very high production is obtained, exceeding that of known conveying systems.

Additional advantageous aspects are shown in the other claims.

The present invention further relates to an apparatus for conveying items that realises the method for conveying items according to the present invention.

Further features of the present invention shall become more readily apparent from the detailed description that follows, made with reference to the accompanying drawings, which represent embodiments provided purely by way of non limiting example.

DESCRIPTION OF THE ILLUSTRATIVE EMBODIMENTS

Figure 1:
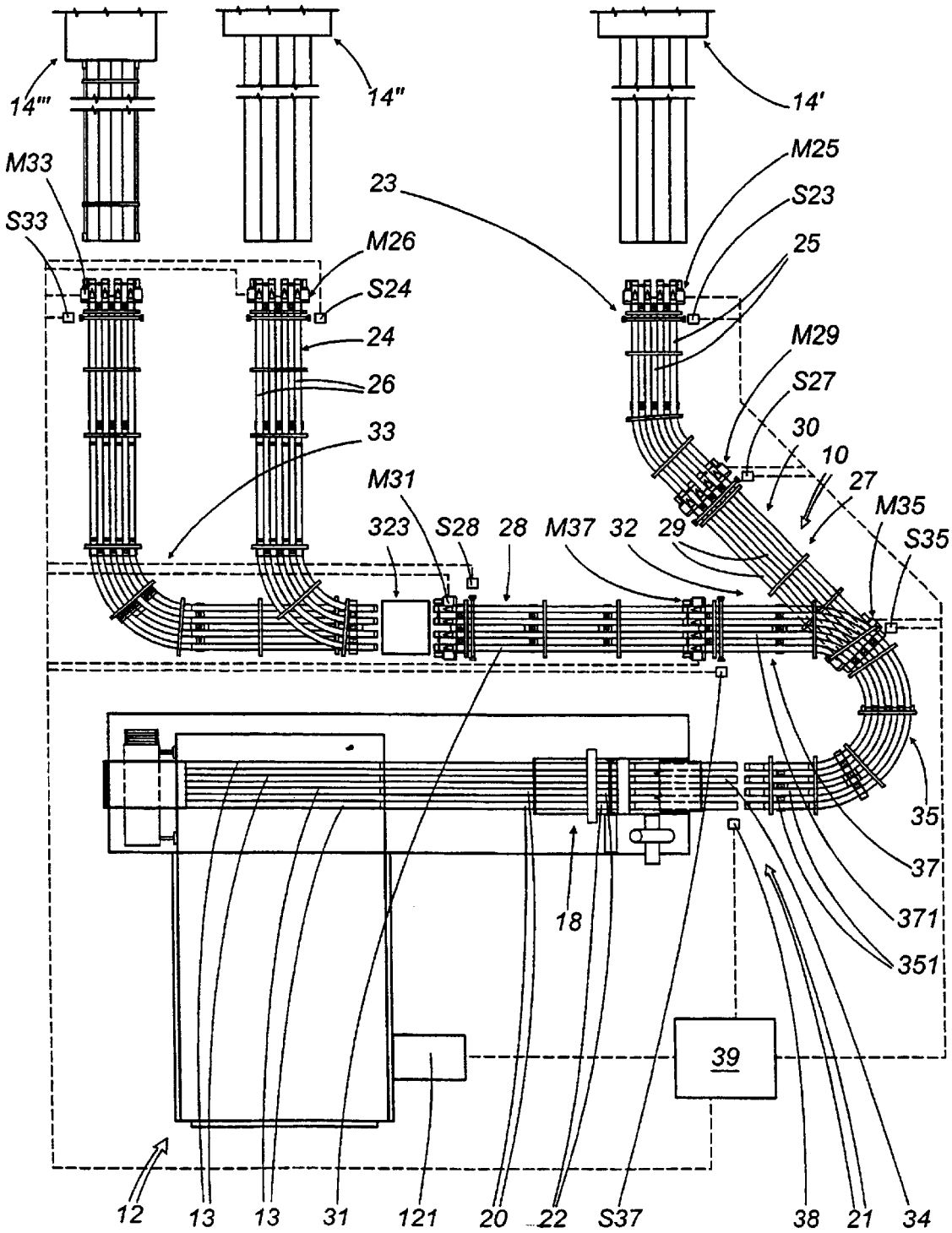
FIG. 1 shows a schematic plan view of a system using the conveying apparatus according to a first embodiment of the present invention.

FIG. 1 shows a system using the first preferred embodiment 10 of conveying apparatus of the present invention. The system comprises a machine 12 for working said items situated upstream, which provides said products or items—in the form of rolls of paper, plastic or similar material obtained starting from respective elongated bodies, or sticks (indicated in FIG. 1 with the numeric reference 13)—by means of equidistant transverse cuts in said stick 13 and, downstream of this machine, a plurality, in particular three machines for treating said items indicated respectively with the numeric references 14', 14" and 14'", in particular in the form of machines for packaging said items which receive said items in a substantially already grouped condition and package them in a respective container, generally constituted by a wrapping film made of plastic material.

Figure 2:
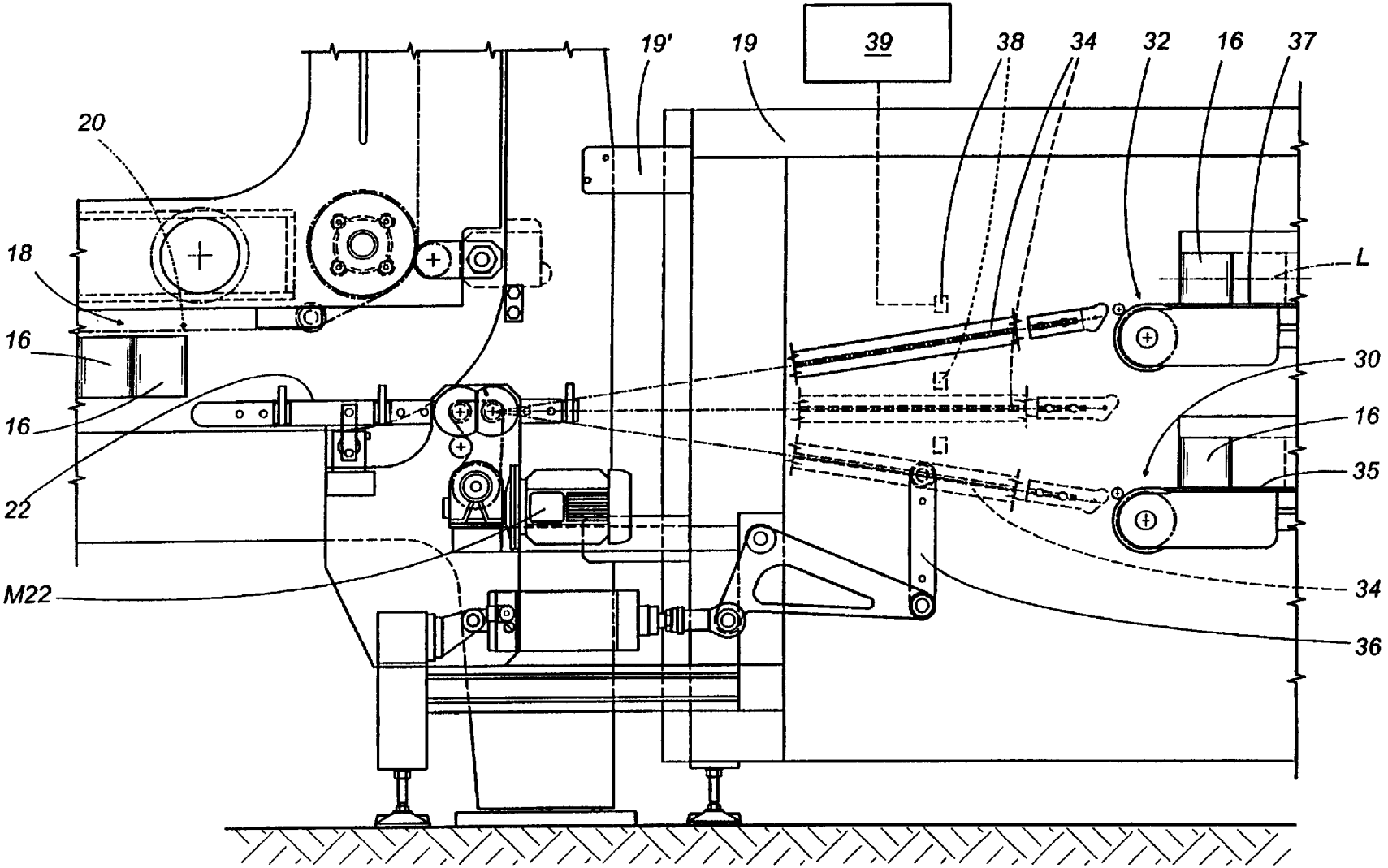
FIG. 2 shows a longitudinal side view of the part of the first embodiment of said conveying apparatus that couples to the machine that produces said items.

As shown particularly in FIG. 2, said rolls with substantially cylindrical shape thus present a respective longitudinal axis L and are advanced along a longitudinal path of advance, with their own longitudinal axis oriented according to the direction of advance.

Figure 3:
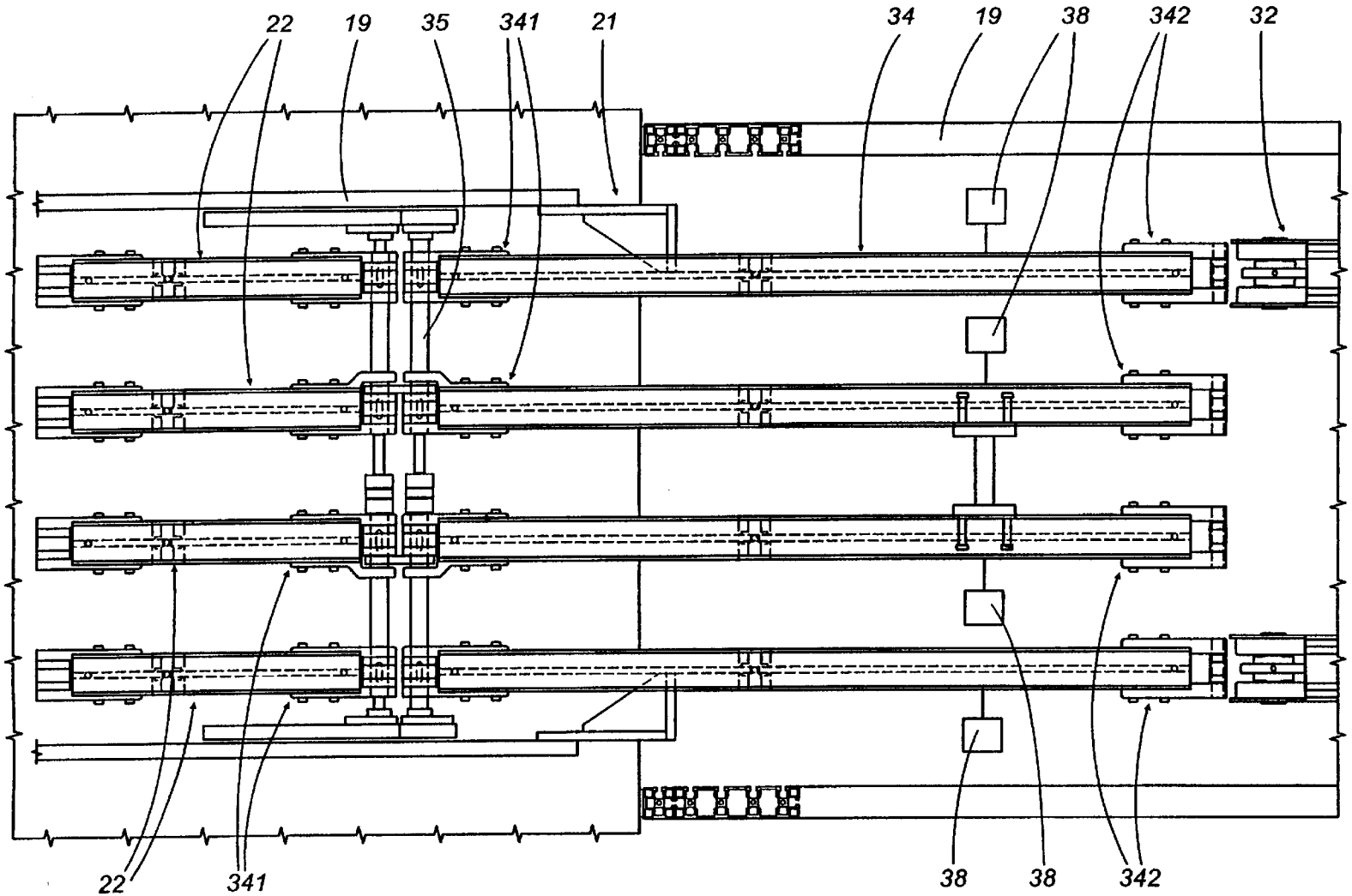
FIG. 3 shows a top view of the part, shown in FIG. 2, of the first embodiment of conveying apparatus which couples to the machine that produces said items.

As FIGS. 2 and 3 clearly show, in the case at hand, the products or items to be packaged are constituted by rolls of toilet paper 16 of particularly compact cylindrical shape, such rolls being particularly short (as shown in FIG. 2) and with rather large outer diameter (as shown in FIG. 3). In particular in the case at hand, as the Figures clearly show, the outer diameter of the roll exceeds the length of the roll itself. Hence, these items in traditional systems are easily prone to being upset when advancing longitudinally.

As shown in FIGS. 1 and 2, in said cutting machine 12 a longitudinal advancer 18 is present with a plurality of lanes, defined by respective longitudinal conveyors 20, for the parallel conveying of said items into groups of items cut from a respective stick. In each group, by effect of the simple transverse cut of the stick 13, each item 16 is, with the respective extreme transverse faces, in the vicinity of or in contact with the opposite transverse faces of the item 16 preceding it or of the one that follows.

To overcome the risk that the items may be upset, maintaining a high conveying speed, according to the present invention conveying means are used that maintain along the entire path said items of each group or stick grouped longitudinally in mutual proximity or contact.

The truncating machine 12 has only one outlet; to distribute the items to the plurality of packaging machines (in the case at hand, as mentioned above, there are three packaging machines), conveying means having a plurality of conveyance planes are provided. In particular in the case at hand, the present conveying apparatus comprises two conveying lines borne by a support frame 19 one over the other on two distinct levels and respectively designated with the reference 30, the lower line or plane, and with the reference 32 the upper line or plane.

Of these two packaging lines, the lower plane 30 conveys the rolls 16 towards a first conveying machine 14', whilst the upper plane 32 conveys said items 16 towards a second machine 14", or possibly following the activation of manually actuated distribution means intermediate to the line, indicated with the numeric reference 323 in FIG. 1, towards a third machine 14'" fed by means of conveying organs 33 which run at the same height as the conveying organs that feed said first machine 14'.

In the preferred embodiment shown, the conveying apparatus comprises a first conveying section 21 able to receive said items when they are released by the cutting machine 12, which comprises a plurality of paired conveying lanes each comprising a respective conveyor 22 for the longitudinal advance of said items.

The number of lanes of the first section is equal to that of the outlets of the cutting machine and it generally differs from the number of lanes present in the downstream sections of the present conveying device.

As shown in FIG. 2, said first conveying section 21 extends within the machine 12, whereto it is fastened by means of suitable means such as the bracket 19', with the conveyors 22 of the section 21 which position themselves underneath the conveyors 20 of the machine 12 to receive the groups of said items 16.

According to the present preferred embodiment, to pass the items from said conveyors 22 to one or the other of said conveying lines or planes 30, 32, or to the various lanes of said conveying planes, in said first section 21 are provided suitable distribution means, comprising a respective movable conveyor 34 which extends from each conveying lane 22. The movable conveyors 34 of the distributor rotate, to position themselves in correspondence with a corresponding downstream conveyor, moving in the vertical and in the horizontal.

Said movable conveyors 34 present an extremity 341 pivoted to a common horizontal axis 35, which is situated at the same height and receives the items coming from said conveyors 22, and one opposite free extremity 342 able to be positioned, by means of an actuating arm 36, respectively in correspondence with the lower plane 30 or of said upper plane 32 or in correspondence with corresponding lanes of said planes or lines 30, 32. The activation of said movable conveyors 34 can be effected simultaneously, and in this case one could also imagine using a single actuating arm for all movable conveyors 34, or individually for each conveyor 34, an actuation arm being used in this case for each conveyor 34. It would therefore be possible to advance the items 16 along all or only some of the conveying lanes towards a respective downstream work machine according to the operative needs of the downstream machine itself. Suitable motor means M22, shown in FIG. 2, actuate the rotation of said conveyor belts 22 and 34.

As shown in FIG. 1, said lower and upper lines 30, 32 present a respective head conveying section 35, 37, each composed of respective conveyor belts 351, 371 which receive the items 16 from said movable conveyors 34 and are commanded to rotate by at least respective motor means indicated with the references M35 and M37. In FIG. 1, the conveyors 351 and 371 of the lower and upper lines are, as shown, mutually superimposed in their initial segment.

FIG. 1 also shows motor means M33 for actuating the rotation of said conveying section 33 for the packaging machine 14".

Moreover, as shown particularly in FIG. 1, both said lower plane 30, and said upper plane 32, present for the corresponding conveying machine 14' or 14", a respective terminal conveying section 23, 24, composed of respective conveyor belts 25, 26 actuated in rotation by means of respective motor means M25 and M26, which terminal conveying section 23, 24 directly provides said groups or trains of items to a respective machine 14', 14" for packaging said items 16.

Between said head sections and said terminal conveying sections of said first and second line or conveying unit, a respective intermediate conveying section 27, 28 is also provided, each composed of respective conveyors 29, 31 actuated in rotation by respective motor means M29 and M31.

The use of the conveying sections 27, 28 achieves an intermediate storage of the items, so that, when the respective packaging machine situated downstream is blocked for any reason, at least a group or train of items can be stopped and momentarily stored, thereby enabling to move the items being produced on the truncating machine 12 onto another conveying line towards another packaging machine, without causing said truncating machine 12 to stop.

In the vicinity of the output extremity of the individual conveying sections are provided respective means for sensing the presence of said items on the respective lanes or conveyor belts. In regard to the first conveying line 30 said sensor means are respectively indicated with the references S35 the sensors at the extremity of the conveying section 35, S27 the sensors at the extremity of the conveying section 27, S23 the sensors at the extremity of the conveying section 23, whilst in regard to the second conveying line 32 said sensor means are respectively indicated with the references S37 the sensors at the extremity of the conveying section 37, S28 the sensors at the extremity of the conveying section 28, and S24 the sensors at the extremity of the conveying section 24. Said sensors are able to signal the presence or absence of a group of items on the respective belt.

Similarly, the reference S33 indicates the sensor means for the conveyor belts of the conveying section 33.

The signals emitted by said sensors are sent to centralised control means 39 that command, depending on the presence or absence of groups of items on the various conveyors, said distribution means to send groups of items on the available conveyors as well as said motor means suitably to vary the speed of advance of said items on the various conveyors.

According to the present preferred embodiment, to prevent the package from being upset while maintaining high conveying speeds i.e. without having to stop said items along the respective conveying lines, in the occasion of the passage of said group or train of items 16 from a conveying section to the other, the conveyors of all said pluralities of conveying sections are made to operate at a speed of advance of the items that does not exceed that of the conveyor that precedes.

Subsequently to the loading of the group of items 16, the conveyors can be made to operate at a desired speed, and in particular at a greater speed in order to increase the conveying speed of the items 16. This speed variation is in any case effected only after one or more groups or whole trains of items have been loaded onto the conveying section.

By way of example, the truncating machine 12 provides groups or trains of items, each obtained from a respective stick or elongated body, which are fed longitudinally and in mutual succession with a longitudinal distance or space, which can range between 200 and 400 mm. Each of the conveying sections therefore presents a length greater than the length of the group of items that is being conveyed, in such a way as to house at least a group, or a plurality of paired groups advancing on parallel belts. At the limit, each of the conveying sections could present a length equal to a whole multiple of said length of the stick with the addition of the measure of the distance between the sticks or groups.

It is further provided for said sensors in correspondence with the output extremity of each conveyor to be positioned, starting from the initial extremity of the conveying section, at a greater distance than that of the stick.

It is further provided for said movable conveying and distribution means 34 to be commanded to move to position themselves in correspondence with said first conveying plane 30 or with said second conveying plane 32 only after the group of items that travels on these movable means has been entirely passed to the other conveying plane. In practice, in order to switch the position of said movable conveyors 34 that move their free end 342 from one to the other of said conveying lines 30, 32, the longitudinal distance, or time interval, present between a group of items and the subsequent group is exploited. In this way, the line switch takes place without any risk of upsetting said items and without having to stop the longitudinal feeding of the items. The result is an even higher average feeding speed of the items.

To command said movable conveying means 34, presence sensor means 38 are provided, situated on said movable distribution means 34 at a predetermined distance from their free end, to indicate, when detecting the presence of said empty gap between successive groups, the passage of a complete group of items.

The computerised control means 39 are also provided for commanding the actuation of said movable conveying means starting from said presence signal coming from the operating sensors 38, as well as other data coming from the conveying system and the machines for packaging said items.

The computerised control means 39 are also connected to the means 121 for controlling the truncating machine 12 in such a way as to allow advantageously to vary the speed of delivery of said items by said upstream machine 12 according at least to a working condition of the conveying apparatus.

In particular, starting from the presence signals emitted by the line sensors, one could imagine suitably decreasing, for instance halving, the working speed of the truncating machine 12 if the downstream lines are overloaded.

Figure 4:
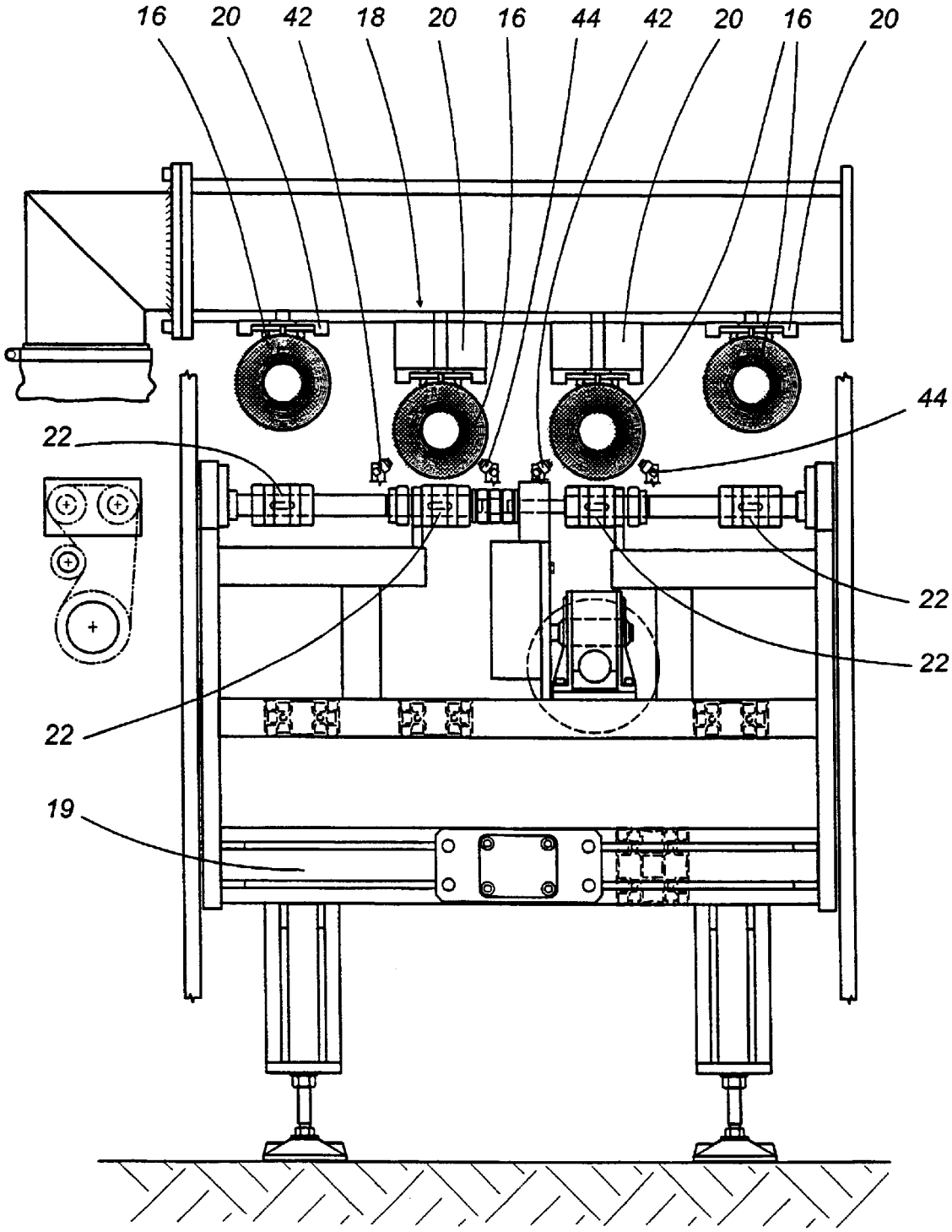
FIG. 4 is a schematic cross section view showing, in particular, the guiding means employed in the present first embodiment.

The conveyors used in the present apparatus are in the form of continuous conveyor belts, longitudinally whereto, as shown in FIG. 4, to maintain the items on the transport plane are provided suitable guiding means comprising opposite longitudinal portions 42, 44 for the lateral engagement of said items, which portions are advantageously situated in a position underlying the centreline of said items.

Such a lowered position of the lateral guides allows to use the present conveying apparatus for rolls of any diameter whatsoever without the need for continuous adjustments of the mutual distance between the lateral guides, as occurred in known conveying systems, where the lateral guiding portions were situated in correspondence with the centreline of said rolls. With prior art guides, when the diameter of the item changed it was necessary correspondingly to change the distance between the lateral guides in order always to keep them in contact with the lateral surface of said rolls.

In particular, in the present case, said guiding portions are situated with respect to the package at an angular position of roughly 55° with respect to the vertical passing through the centre of the package.

In the present conveying apparatus, the sticks can present a length of 3 m and each channel feeds from 100 to 300 rolls per minute, each conveying belt travelling at a speed preferably ranging from 10–40 meters per minute.

One could also imagine in the present embodiment that said control means 39 change in a co-ordinated manner the speed whereat the items are advanced by the individual sections or the conveyor belts according to the speed of advance of the other sections, in order, for instance, to guarantee as constant a flow speed of said items as possible along the line.

With the present invention, the fact that the items obtained from each individual stick are conveyed in such a way as to remain in mutual contact from the very first phases of conveyance and along the path, causes said items, during the conveyance, to be sustained by the previous one and by the subsequent one, thereby preventing them from upsetting, and eliminating, or at least greatly reducing, the risk of interrupting or slowing the conveying operation along the line. The conveying of considerable quantities of items is obtained along with the possibility of making said cutting machines and said packaging machines operate at their maximum operating speed.

A second preferred embodiment of apparatus according to the present invention is shown in FIGS. 5 through 8. For the sake of descriptive convenience, in said figures the elements which are similar or equivalent to those of the first preferred embodiment are indicated with the same numeric references employed to describe the first preferred embodiment.

Figure 5:
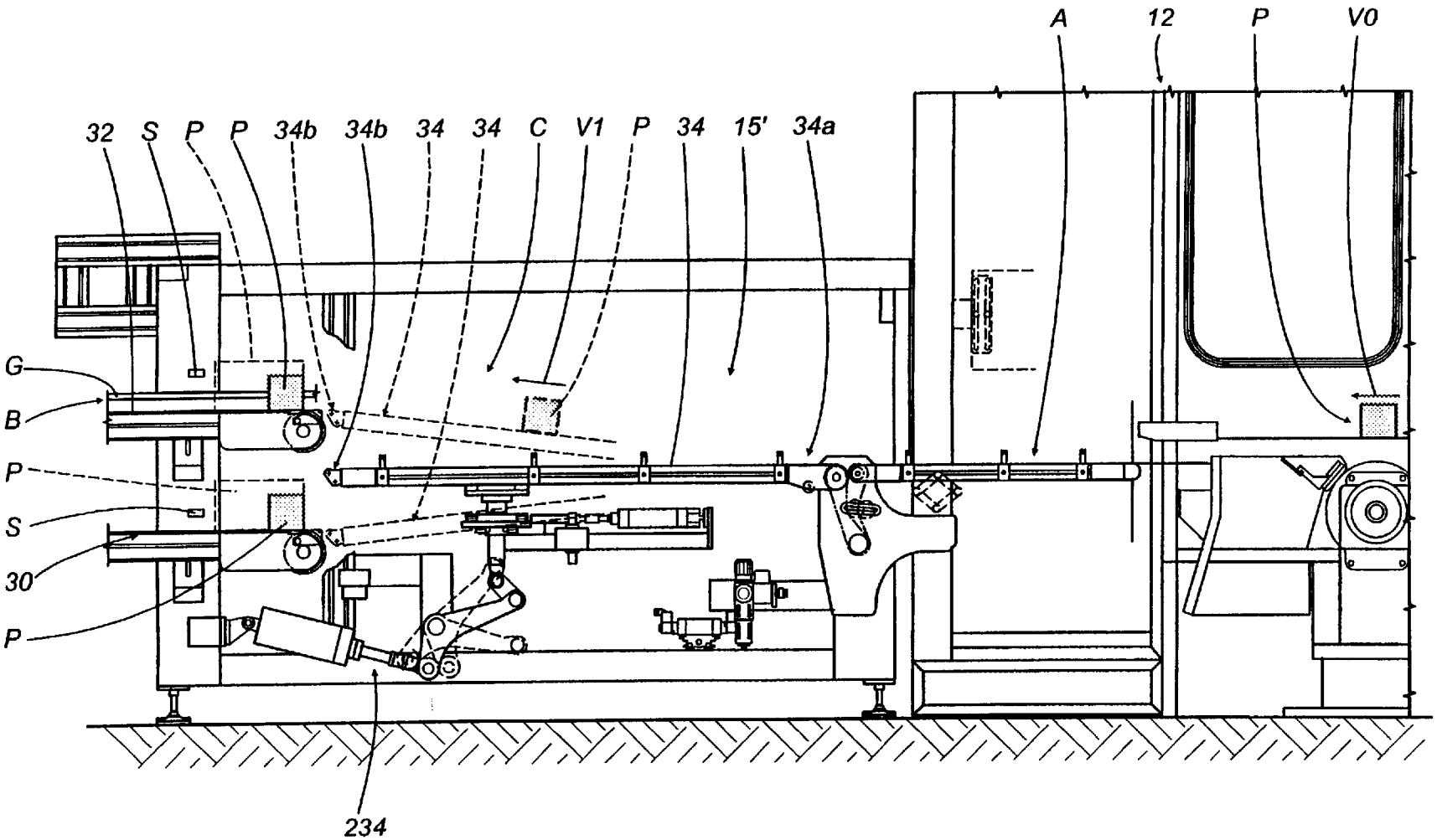
FIG. 5 shows a longitudinal view of the initial part of the conveying apparatus according to a second preferred embodiment of the invention.
Figure 6:
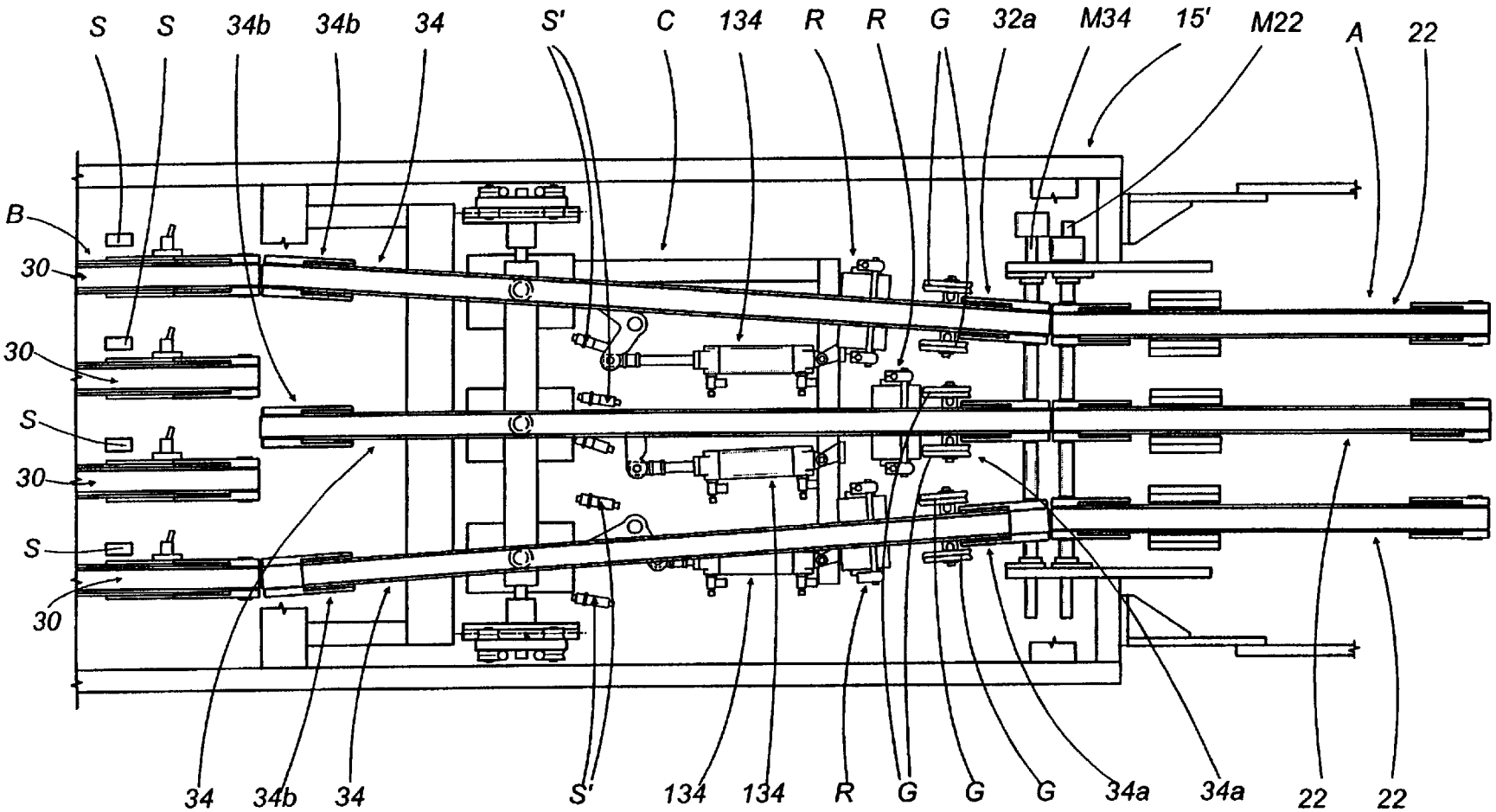
FIG. 6 shows a top view of the initial part of the conveying apparatus according to the second preferred embodiment of the invention.
Figure 7:
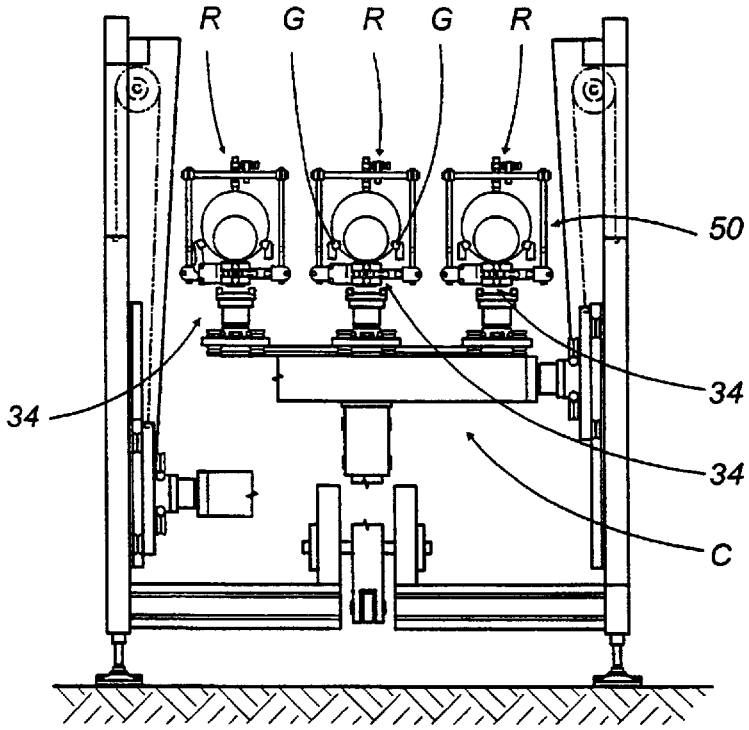
FIG. 7 shows a transverse view relating to the movable distribution part of the second preferred embodiment of the invention.

In accordance with FIGS. 5 through 7 of the accompanying drawings, it can be observed that the apparatus for conveying items designated with the reference P in these figures, comprises a line for transporting said items which can be similar to that of the first embodiment, whereof only the initial part designated with the numeric reference 15' is shown in the figures. The line is able to transport said items P from a machine 12 for working said items situated upstream, where a series of rolls made of paper material are provided starting from sticks or reels of larger dimensions, to a series of packaging machines positioned downstream, which are not expressly shown in the accompanying figures.

In practice, said working machine 12 situated upstream advances and cuts simultaneously one or more reels of paper material, to obtain therefrom a series of individual rolls of paper material, destined prevalently to household use, which are advanced at a predefined speed, exemplified with the arrow V0 in FIG. 1, and transferred to the subsequent conveying apparatus.

It is possible that, in some known cutting machines, the groups of items P cut from the same reel are advanced and transferred at a variable speed. In particular, it may occur that, after cutting one or more reels, in said cutting machines 12, in order rapidly to make room in the cutting area to one or more successive reels, the reels are rapidly accelerated, reaching a speed which may even be about 2.5 to 3.5 times the speed which the reels present normally while individual rolls are cut.

From the aforementioned figures, it is further noted that the present embodiment of apparatus presents a conveying line that comprises a first segment A for receiving said items P from said upstream working machine 12, which presents one or more lanes 22 for advancing said items, and a second segment B, downstream of said first segment A, which presents a plurality of conveying lanes 30, 32 positioned on two planes at different levels and in a number exceeding that of the lanes of the first segment A.

The present embodiment of apparatus further presents an intermediate segment C, which is positioned between said first segment A and said second segment B and presents one or more movable lanes 34 for distributing the items P from the lanes 22 of said first segment A to the lanes 30, 32 of the second segment B.

Said lanes are defined, in a substantially known manner, by respective conveyor belts, and related longitudinal guides, which extend substantially over the entire length of said lanes and which contact laterally said items which longitudinally slide in contact therewith. Said guides are shown only in part in the aforementioned figures and are indicated in their entirety with reference G.

Said belts defining the movable lanes 34 present a fixed extremity 34*a*, in correspondence with which they receive the products from the section A of the line, and are also able to be oriented in space, rotating with respect to said extremity 34*a*, upon the activation of respective actuating means 134, 234, in particular of the pneumatic type, but which could also be electric, hydraulic or mechanical.

By suitably orienting the respective ribbon 34, it is possible to bring the free extremity 34*b* for transferring the product in correspondence with a receiving extremity of a belt 30, 32 of the conveying section C situated downstream.

Each conveying section A, B, C presents respective driving means able to activated in mutually independent manner, whereof those for the conveying sections A and C are exemplified by driving shafts indicated with the references M34 and M22 in FIG. 6.

According to a particularly advantageous mode, at least in the initial part 15' of said conveying line downstream of the working machine 12, the speed of advance V1 of said items is maintained substantially equal to the advance and transfer speed V0 of said working machine 12 situated upstream.

In practice, if the advance and transfer speed V0 of the working machine 12 situated upstream varies between a minimum value and a maximum value, the speed of advance V1 of said items is also appropriately varied in such a way as to maintain it, at all times, substantially equal to the speed of advance and transfer V0 of the working machine 12 situated upstream.

In order to attain high average transport speeds of the items, minimising wear and risk of upsets, it would also be preferred for all, or in any case most, sections of the conveying line also to maintain or vary their speed of advance of the items P in accordance with the speed of advance provided for the sections immediately downstream of the cutting machine 12.

Although this fact is not expressly shown in the accompanying figures, the present apparatus comprises electronic control means, in the form of an electronic computer or the like, which regulate the operating speed of the various means for driving said belts advancing the items.

In particular, in order to set and adjust said speeds of advance in the various sections of the line, the available data relating to the speeds of advance of the sticks or reels within the cutting machine 12 are inserted and appropriately processed by the electronic computer, which, starting from said data, correspondingly sets the speed of advance of said belts of the present conveying apparatus, especially, as stated above.

The operation of the present apparatus is further controlled thanks to appropriate sensors disseminated along the line.

Figure 8:
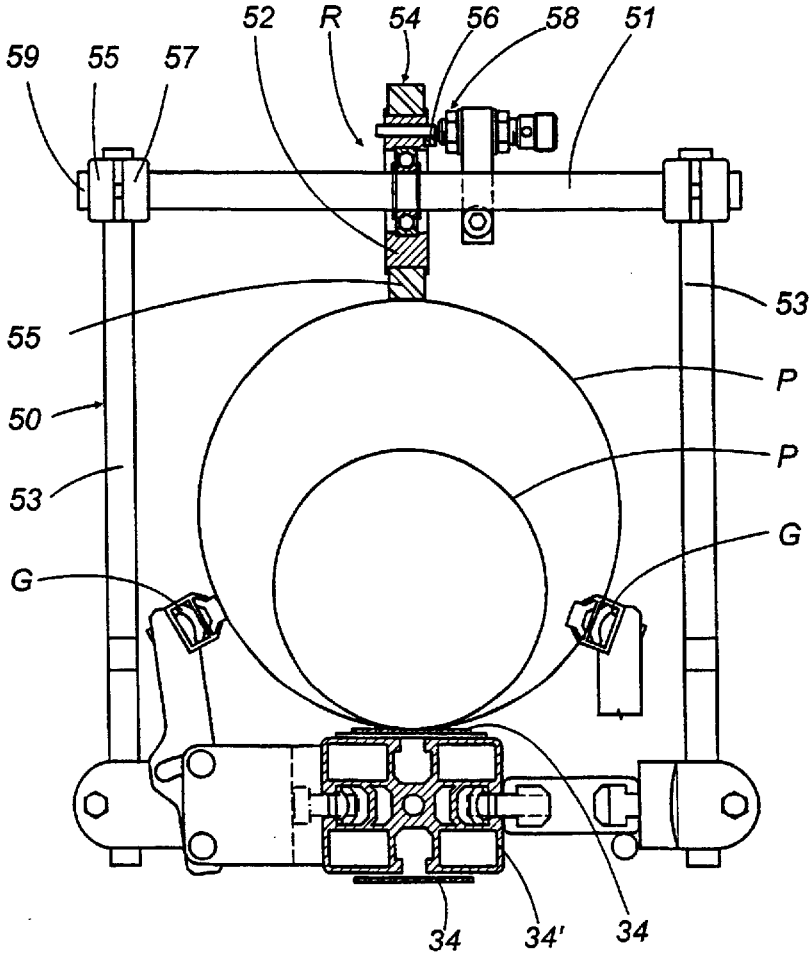
FIG. 8 shows a view of a detail relating to the sensor means able to detect a condition of advancing motion of said items, in said second preferred embodiment of apparatus.

In particular, in the present apparatus sensor means are used, indicated with reference R in FIGS. 7 and 8, which are able to detect a condition of advancing motion of said items P.

Such sensors R could be used in any suitable point of the line, however they are preferably used on the movable lanes 34 of the intermediate distribution section C, with the purpose of indicating, for instance, a clogged situation on the respective lane 34, possibly caused by an item jamming between the transfer extremity 34*b* of the movable belt and the subsequent extremity of the ribbons 30 and 32.

Said sensor means R for detecting a condition of motion of the items are better illustrated in the subsequent FIG. 8. Said figure shows how the sensor R is supported by appropriate support means 50 which comprise a crosspiece 51 and two lateral uprights 53 which extend above the corresponding transport lane 34 and are fastened directly to the spar 34' that sustains the belt 34. This configuration of the support means allows to position said sensor R above said items P.

As shown in said FIG. 8, said sensor means R able to detect the maintenance of a condition of advancing motion of said items P comprise a roller 52, mounted free to rotate on the crosspiece 51, which presents an outer ring made of rubber or equivalent material 55, which defines a peripheral surface 54 in contact with the items P.

The advance of items P on the corresponding belt causes the rotation of the roller 52, which suitably detected allows to indicate the condition of advancing motion of the items themselves.

In order to detect the aforesaid rotation of said rotating contact roller 52, in the present embodiment, appropriate means are provided comprising at least a protuberance 56 integral to said rotating contact roller and projecting laterally therefrom, and suitable switch means 58, in the form of a micro-switch fastened to said crosspiece 51, whose sensitive extremity is activated by the engagement of said protuberance 56, when it passes in correspondence with said active extremity of the micro-switch 58.

This contact of the projection with the switch 58 causes the closure of an electrical contact, whereto corresponds the emission of a corresponding electrical impulse signalling the rotation of the roller 52.

Said support means 50 are adjustable, in particular adjustable in height to adapt the position of said roller 52 to the dimensions of the items P to be detected.

For this purpose, in correspondence with each lateral extremity of the crosspiece 51 are provided a first and a second jaw 55, 57 for fastening the corresponding upright 53, which, by means of a screw 59, are approached, to fasten the respective upright 53 and lock the crosspiece 51 thereto, and are removed to free the respective upright and allow to move the crosspiece vertically towards a new working position.

Further provided, for each lane 30, 32 downstream of said movable distribution lanes 34, are additional sensor means, for instance optical sensors, which are indicated with the reference S in FIGS. 5 and 6 and which are able to sense the presence of items P.

It is also possible to provide further optical sensor means, indicated with reference S' in FIG. 6, able to sense the presence of the items on the movable belts 34.

Said presence sensor means S are positioned at a predefined distance from the receiving extremity of the respective lane 30, 32.

Said sensor means S in combination with said sensor means R allow reliably to perform the switching operations of the section C with no risk of jamming.

When the sensor S signals that the last item of the train of items has passed by, a single belt 34 can be switched from a belt 30 or 32 to another one. In this case, the additional signal, by the sensor R, that the successive group of items is advancing, provides the further indication that no item is jammed between the transfer extremity of the corresponding belt 34 and the subsequent belt 30 or 32, and thus allows to perform such a switch in a condition of safety.

The signals coming from the sensors S' can be used individually or in combination with those of the sensors S to perform their same function.

In the upstream working machine 12, between said groups of items P fed longitudinally and in mutual succession is present a longitudinal space or distance. Also in the present embodiment, the movable conveying means 34 able to distribute said items to the lanes 30, 32 situated downstream are commanded to move vertically or horizontally to position themselves in correspondence with a respective lanes downstream of the sections 30, 32 exploiting the time interval between the passage of the last item of the train of items just passed to the lanes downstream of the sections 30, 32 and the arrival, in correspondence with the transfer extremity of the movable means 34, of the first item of the subsequent train of items.

Although a conveying apparatus has been illustrated herein which transports and distributes said items between an upstream working machine and various downstream working machines, one could also imagine associating said apparatus to any type and number of machines, as well as inserting the present apparatus between already readied lines and not between machines working the transported articles. Therefore in the present context, the term "working machine" must be understood in a broader sense, extended for instance also to the case of conveying lines, situated upstream and downstream, differing from the present conveying apparatus. The present conveying apparatus in this case would function as a modular element able to be associated to any upstream apparatus and any downstream apparatus.

According to a further embodiment (not expressly shown in the accompanying figures), said belts 22 and 34 can be actuated with independent motors. This allows, among other advantages, to move, when desired (for instance when it is realised that the gap does not correspond to the required one), the items that arrive on the conveyor belts 34 at a greater speed than that of the belts 22, thereby creating between said items or between the groups of items a desired and appropriate distance.

According to yet another embodiment (not expressly shown in the accompanying figures), the working speed of the packaging machine or the like situated downstream of the present apparatus could be commanded, through the central control unit 39, to suit it, by increasing or decreasing it, to the advancement requirements of the present apparatus.

Although the present embodiment has been illustrated for the conveyance of rolls of paper material, the present conveying apparatus is nonetheless suitable to transporting items of any kind.

What is claimed is:

1. Method for conveying items, in the form of substantially cylindrical rolls (P, 16) of material having a longitudinal axis (L) and extreme transverse faces, in a system for producing and packing said rolls having an upstream working machine (12), at least a downstream working machine (14', 14") for packing said rolls, and a conveying apparatus between said upstream working machine (12) and said at least one downstream working machine (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present;

said conveying apparatus having an initial part (15') comprising a first conveying segment (A, 21) which receives the rolls when they are released from the upstream cutting machine (12), comprising the steps of:

in said initial part (15') of the conveying apparatus, which receives said rolls from the cutting machine (11), maintaining the speed (V1) of advance of the rolls substantially equal to the speed (V0) of advance and transfer of the rolls by said upstream cutting machine (12);

maintaining the rolls cut from a respective stick in said cutting machine grouped to each other in such a way that each roll of the group of rolls cut by the respective stick has its transverse faces placed in the vicinity or in contact to the transverse faces of the adjacent rolls so that they can contact each other and avoid upsetting the rolls; and maintaining a gap or time interval between each group of rolls obtained by transversally cutting a respective elongated stick and the group of rolls obtained by a subsequently cut stick, wherein said rolls being conveyed are paper tissue rolls.

2. Method according to claim 1, wherein the speed of advance and transfer (V0) of the working machine (12) situated downstream varies between a minimum value and a maximum value, wherein the speed of advance of said items (V1) is varied in such a way as to maintain it, at all times, substantially equal to the speed of advance and transfer (V0) of the working machine (12) situated upstream (12).

3. Method according to claim 1, wherein, in order to control the feeding of the items (P) by said upstream work machine (12), the maintenance of a condition of motion of said items (P) is sensed in at least a predetermined point of the line (15).

4. Method according to claim 1, wherein, in order to carry longitudinally said items (16) from said upstream machine (12) to said downstream machine (14), said items are advanced in longitudinal groups or trains of items; and in that, in each group or train of items, said items (16) are longitudinally approached to each other.

5. Method according to claim 1, wherein said items (16) are advanced along the path between said upstream machine (12) and said downstream machine (14) through a conveying apparatus comprising one or more conveying sections (21, 35, 37, 27, 28, 23, 24) longitudinally advancing said items (16), and wherein, at least upon the passage of said group or train of items (16) at each of said conveying sections (21, 35, 37, 27, 28, 23, 24), the speed of advance of the items of said one or more conveying sections (21, 35, 37, 27, 28, 23, 24) is such as not to exceed the speed of advance whereat said items (16) are advanced in the unit upstream of the same section whereto the items (16) are passed, in such a way as to advance said items (16) maintaining them longitudinally grouped together.

6. Method according to claim 5, wherein the speed of advance of the items (16) in each conveying section (21, 35, 37, 27, 28, 23, 24) is varied only after one or more groups or trains of items have been loaded onto said section (21, 35, 37, 27, 28, 23, 24).

7. Method according to claim 1, wherein between said ground of items (16) fed longitudinally and in mutual succession by said upstream work machine (12) a longitudinal space or distance is present, and wherein at least a first (30) and a second (32) conveying unit are provided, destined to feed different machines, and movable conveying means (34) able to distribute said items (16) to said first (32) or to said second (34) conveying plane, and means (36, 38, 39) to command said conveying means to be positioned in correspondence with said first or with said second line or vice versa, and in that said movable conveying and distribution means (34) are commanded to move to position themselves in correspondence with said first (32) or with said second (34) conveying line only after the group of items has been entirely passed to the other conveying line.

8. Method according to claim 7, wherein to command said movable conveying means the presence of said articles (16) is sensed in correspondence with said movable distribution means (34) in order to indicate, by detecting the presence of said empty gap between successive groups, the passage of a complete group of items (16) and to command the actuation of said movable conveying means (34) starting from said presence signal.

9. Method according to claim 1, wherein the speed whereat said items (16) are delivered by said upstream machine (12) is varied as a function of at least one working condition of the conveying apparatus (10).

10. Method according claim 1, wherein the speed of advance of the items (16) of the individual conveying sections (21, 35, 37, 27, 28, 23, 24) is varied in a co-ordinated manner to that of the other conveying sections (21, 35, 37, 27, 28, 23, 24).

11. Method according to claim 1, providing activation in a mutually independent manner means (22) for advancing the items, situated upstream, and means (34) for advancing the items, situated downstream, to create, as needed, a pre-set distance between said items or between the groups of items.

12. Method according to claim 1, comprising the further step of commanding the working speed of the downstream utilisation to suit the advancement requirements of the advancing line (15).

13. Method for conveying items in the form of substantially cylindrical rolls (P, 16) of material having a longitudinal axis (L) and extreme transverse faces; in a system for producing and packing said rolls comprising an upstream working machine (12), at least first and second downstream working machines (14', 14") for packing said rolls, and a conveying apparatus located between said upstream working machine (12) and said first and second downstream working machines (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present; said conveying apparatus having an initial part (15') comprising a first conveying segment (A, 21) which receives the rolls when they are released from the upstream cutting machine (12), and movable conveying means (34) are commanded to be positioned in correspondence of a first (30) or a second (32) conveying units for distributing said rolls towards corresponding downstream packing machines (14, 14"); the, comprising the steps of:

in said initial part (15') of the conveying apparatus, which receives said rolls from the cutting machine (11), maintaining the speed (V1) of advance of the rolls substantially equal to the speed (V0) of advance and transfer of the rolls by said upstream cutting machine (12), in such a way that the rolls cut from a respective stick in said cutting machine are maintained grouped to each other so that each roll of the group of rolls cut by the respective stick has its transverse faces placed in the vicinity or in contact to the transverse faces of the adjacent rolls for contacting each other and for avoiding upsetting of the rolls;

maintaining a gap or time interval between each group of rolls obtained by transversally cutting a respective elongated stick and the group of rolls obtained by a subsequently cut stick; and operating said movable conveying means (34) to switch the position for distributing the rolls to said first (30) or to said second (32) conveying units only after the respective group of rolls, which is conveyed to a respective conveying unit (30 or 32), has been entirely passed to the same unit (30 or 32) in such a way to exploit, for switching the position of said movable conveying means (34), the gap or time interval which is present between the group of items just passed and the arrival of a subsequent group of items, wherein, said rolls being conveyed are paper tissue rolls.

14. Method according to claim 13 wherein, in case the gap between successive groups is not as required, increasing the distance between groups in correspondence of said movable conveying means (34) by increasing the speed of the conveyor belts of said movable conveying means (34).

15. Method for conveying items in the form of substantially cylindrical rolls (P, 16) having a longitudinal axis (L) and extreme transverse faces; in a system for producing and packing said rolls comprising an upstream working machine (12), at least a downstream working machine (14', 14") for packing said rolls, and a conveying apparatus between said upstream working machine (12) and said downstream working machine (14', 14"), comprising the steps of:

controlling, by a centralised control unit (39), the rolls speed of advance of the conveying apparatus, the rolls speed of delivery of said upstream cutting machine, and wherein the rolls speed of delivery of said upstream cutting machine, is controlled by said centralised control unit (39) according at least to a working condition of the conveying apparatus, wherein, said rolls being conveyed are paper tissue rolls, and said upstream cutting machine is a truncating machine (12).

16. Method for conveying items in the form of substantially cylindrical rolls (P, 16) having a longitudinal axis (L) and extreme transverse faces; in a system for producing and packing said rolls comprising an upstream working machine (12), at least a downstream working machine (14', 14") for packing said rolls, and a conveying apparatus between said upstream working machine (12) and said downstream working machine (14', 14"), the conveying method comprising the steps of:

controlling, by a centralised control unit (39), the rolls speed of advance of the conveying apparatus, the rolls speed of delivery of said upstream cutting machine, and the working speed of the packaging machine;

wherein said centralised control unit (39) provides for commanding the working speed of the downstream utilisation to suit it to the advancement requirements of the advancing line (15), and said rolls being conveying are paper tissue rolls.

17. Method for conveying items in the form of substantially cylindrical rolls (P, 16) having a longitudinal axis (L) and extreme transverse faces; in a system for producing and packing said rolls comprising an upstream working machine (12), at least a downstream working machine (14', 14") for packing said rolls, and a conveying apparatus between said upstream working machine (12) and said downstream working machine (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present, the conveying method comprising the steps of:

controlling, by a control unit (39), the rolls speed of advance of the conveying apparatus; and the rolls speed of delivery of said upstream cutting machine, said control means providing for setting and adjusting the speed of advance of the conveyor belts of the conveying apparatus of the conveying line in accordance with the speed of advance of the stick within the upstream cutting machine, wherein, said rolls being conveying are paper tissue rolls.

18. Method for conveying items in the form of substantially cylindrical rolls (P, 16) having a longitudinal axis (L) and extreme transverse faces; in a system for producing and packing said rolls comprising an upstream working machine (12), at least a first and a second downstream working machine (14', 14") for packing said rolls, and a conveying apparatus between said upstream working machine (12) and said downstream working machines (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present; said conveying apparatus having movable conveying means (34) which are commanded to be positioned in correspondence of a first (30) or a second (32) conveying units for distributing said rolls towards corresponding downstream packing machines (14, 14"), the conveying method comprising the steps of:

controlling, by a control unit (39), the rolls speed of advance of the conveying apparatus; and the rolls speed of delivery of said upstream cutting machine, wherein said centralised control unit (39) provides for commanding the actuation of said movable conveying means starting from data coming from the conveying system and from the packing machines, and said rolls being conveying are paper tissue rolls.

19. Method for conveying items in the form of substantially cylindrical rolls (P, 16) having a longitudinal axis (L) and extreme transverse faces; in a system for producing and packing said rolls comprising an upstream working machine (12), at least a downstream working machine (14', 14") for packing said rolls, and a conveying apparatus between said upstream working machine (12) and said downstream working machine (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present; wherein between said upstream machine (12) and said downstream machine (14) the conveying apparatus comprises a plurality of conveying sections (21, 35, 37, 27, 28, 23, 24) longitudinally advancing said items (16), and wherein, in order to carry longitudinally said items (16) from said upstream machine (12) to said downstream machine (14), said items are advanced in longitudinal groups or trains of items, the conveying method comprising the steps of:

controlling, by a control unit (39), the rolls speed of advance of the conveying apparatus; and the rolls speed of delivery of said upstream cutting machine, wherein said centralised control unit (39) provides that the speed of advance of the items (16) in each conveying section (21, 35, 37, 27, 28, 23, 24) is varied only after one or more groups or trains of items have been loaded onto said section (21, 35, 37, 27, 28, 23, 24), and said rolls being conveying are paper tissue rolls.

20. Apparatus for conveying items in the form of substantially cylindrical rolls (P, 16) having a longitudinal axis (L) and extreme transverse faces; in a system for producing and packing said rolls comprising an upstream working machine (12), at least first and second downstream working machines (14', 14") for packing said rolls, and a conveying apparatus between said upstream working machine (12) and said first and second downstream working machines (14', 14"); said upstream working machine (12) transversely and in succession cutting said rolls from respectively elongated sticks and advancing and exiting said rolls cut by respective sticks in such a way that between the rolls cut by a stick and the rolls cut by a subsequently cut stick a longitudinal space is present;

said conveying apparatus having an initial part (15') comprising a first conveying segment (A, 21) which receives the rolls when they are released from the upstream cutting machine (12), the conveying apparatus comprising that in said initial part (15') of the conveying apparatus, which receives said rolls from the cutting machine (11), the speed (V1) of advance of the rolls is maintained substantially equal to the speed (V0) of advance and transfer of the rolls by said upstream cutting machine (12), in such a way that the rolls cut from a respective stick in said cutting machine are maintained grouped to each other, in such a way that each roll of the group of rolls cut by the respective stick has its transverse faces placed in the vicinity or in contact to the transverse faces of the adjacent rolls so that they can contact to each other for avoiding upsetting of the rolls, and in such a way that a gap or time interval is present between each group of rolls obtained by transversally cutting a respective elongated stick and the group of rolls obtained by a subsequently cut stick, wherein, said rolls are paper tissue rolls.

21. Apparatus according to claim 20, wherein the speed of advance and transfer (V0) of the working machine (12) situated downstream varies between a minimum value and a maximum value, characterised in that the speed of advance of said items (V1) is varied in such a way as to maintain it, at all times, substantially equal to the speed of advance and transfer (V0) of the working machine (12) situated upstream (12).

22. Apparatus according to claim 20, further comprising sensor means (S, S=) able to sense the presence of items (P) on the lanes (34) of the distribution section and on the lanes (32, 34) downhill therefrom.

23. Apparatus according to claim 20, wherein said items (P) are advanced in longitudinal groups or trains of items.

24. Apparatus according to claim 20, wherein said items (16) are advanced, through said conveying apparatus (10), along a longitudinal path of advance which extends starting from a machine (12) for working said items situated upstream to at least a machine (14) for treating said items situated downstream, said conveying apparatus comprising one or more conveying sections (21, 35, 37, 27, 28, 23, 24) for the longitudinal advance of said items (16), wherein, in order to make said items (16) advance maintaining them longitudinally grouped together, the speed of advance in each of said one or more conveying sections (21, 35, 37, 27, 28, 23, 24), at least upon the passage of said group or train of items (16) at each of said conveying sections (21, 35, 37, 27, 28, 23, 24), is such as not to exceed the speed of advance whereat said items (16) are advanced in the unit upstream of the same section whereto the items (16) are passed.

25. Apparatus according to claim 24, wherein means (39) are provided, able to command the variation of speed of conveyance in each of said conveying sections (21, 35, 37, 27, 28, 23, 24), said command means (39) acting in such a way that the speed of advance of the items (16) in each conveying section (21, 35, 37, 27, 28, 23, 24), is varied only after one or more whole groups or trains of items have been loaded onto said section (21, 35, 37, 27, 28, 23, 24).

26. Apparatus according to claim 20, wherein between said groups of items (16) fed longitudinally and in mutual succession by said upstream working machine (12) is present a longitudinal space or distance, wherein said conveyor apparatus presents at least a first (30) and a second (32) conveying lines destined to feed different machines, movable distribution means (34) able selectively to convey said items (16) to each of said conveying lines (30, 32), and means (36) for commanding said conveying means to position themselves in correspondence with a respective conveying line (30, 32), and in that said movable conveying and distributing means (34) are commanded to move to position themselves in correspondence with a respective conveying line (30, 32) only after the group of items has been entirely passed to the previous conveying line (30, 32).

27. Apparatus according to claim 26, wherein said means for commanding the movable conveying means comprise sensor means (38) positioned in correspondence with said movable distribution means (34) to indicate, detecting the presence of said empty gap between successive groups, the passage of a complete group of items (16), control means (39) being provided to command the actuation of said movable conveying means (34) starting from said presence signal.

28. Apparatus according to claim 20, wherein control means (39) are provided, able to vary the speed of delivery of said items (16) by said upstream machine (12) as a function of at least a working condition of the conveying apparatus (10).

29. Apparatus according to claim 27, wherein each of said conveying sections (21, 35, 37, 27, 28, 23, 24) presents a plurality of parallel conveying lanes, in that said movable distribution means present for each lane a respective movable conveyor (34), and in that the actuation of said movable conveyors (34) can be effected simultaneously or individually for each conveying lane.

30. Apparatus according to claim 27, wherein said first (30) and second (32) conveying lines are positioned one above the other.

31. Apparatus according to claim 25, wherein each of the conveying sections (21, 35, 37, 27, 28, 23, 24) presents a length exceeding the length of the group of items (16) being conveyed.

32. Apparatus according to claim 20, wherein guiding means for said items are provided, said guiding means comprising opposite longitudinal portions (42, 44) for the lateral engagement of said items (16), wherein said guiding portions (42, 44) are situated in a position underneath the centreline of said items (16).

33. Apparatus according to claim 20, wherein control means (39) are provided, acting in such a way that the speed of advance of the items (16) of the individual conveying sections (21, 35, 37, 27, 28, 23, 24) is varied in a co-ordinated manner to that of the other conveying sections (21, 35, 37, 27, 28, 23, 24).

34. Apparatus for conveying items in the form of substantially cylindrical rolls (P, 16) having a longitudinal axis (L) and extreme transverse faces in a system for producing and packing said rolls comprising an upstream working machine (12), at least a first and a second downstream working machines (14', 14") for packing said rolls, and a conveying apparatus between said upstream working machine (12) and said first and second downstream working machines (14', 14") said conveying apparatus having an initial part (15') comprising a first conveying segment (A, 21) which receives the rolls when they are released from the upstream cutting machine (12) and is defined by conveyor belts, and movable conveying means (34) which are defined by conveyor belts and which are commanded to be positioned in correspondence of a first (30) or a second (32) conveying units for distributing said rolls towards corresponding downstream packing machines (14, 14"); the conveying apparatus providing that in said initial part (15') of the conveying apparatus, which receives said rolls from the cutting machine (11), the speed (V1) of advance of the rolls is maintained substantially equal to the speed (V0) of advance and transfer of the rolls by said upstream cutting machine (12), in such a way that the rolls cut from a respective stick in said cutting machine are maintained grouped to each other, in such a way that each roll of the group of rolls cut by the respective stick has its transverse faces placed in the vicinity or in contact to the transverse faces of the adjacent rolls so that they can contact to each other for avoiding upsetting of the rolls, and in such a way that a gap or time interval is present between each group of rolls obtained by transversally cutting a respective elongated stick and the group of rolls obtained by a subsequently cut stick; and that said movable conveying means (34) switch the position for distributing the rolls to said first (30) or to said second (32) conveying units only after the respective group of rolls, which is conveyed to a respective conveying unit (30 or 32), has been entirely passed to the same unit (30 or 32) in such a way to exploit, for switching the position of said movable conveying means (34), the gap or time interval which is present between the group of items just passed and the arrival of a subsequent group of items, wherein, said rolls are paper tissue rolls.

35. Apparatus according to claim 34 further comprising, the a case in which the gap between successive groups is not as required, means for increasing the distance between groups in correspondence of said movable conveying means (34), by increasing the speed of the conveyor belts of said movable conveying means (34).

36. Apparatus for conveying items in the form of substantially cylindrical rolls (P, 16) having a longitudinal axis (L) and extreme transverse faces in a system for producing and packing said rolls comprising an upstream working machine (12), at least a downstream working machines (14', 14") for packing said rolls, and a conveying apparatus between said upstream working machine (12) and said downstream working machine (14', 14"); the conveying apparatus includes a centralised control unit (39) for controlling the rolls speed of advance of the conveying apparatus, and the rolls speed of delivery of said upstream cutting machine;

wherein the rolls speed of delivery of said upstream cutting machine, in controlled by said centralised control unit (39) according at least to a working condition of the conveying apparatus and said rolls are paper tissue rolls.

37. Apparatus according to claim 36, wherein said upstream working machine (12) is a truncating machine (12).

38. Apparatus for conveying items in the form of substantially cylindrical rolls (P, 16) having a longitudinal axis (L) and extreme transverse faces in a system for producing and packing said rolls comprising an upstream working machine (12), at least a downstream working machines (14', 14") for packing said rolls, and a conveying apparatus between said upstream working machine (12) and said downstream working machine (14', 14"); the conveying apparatus including a centralised control unit (39) for controlling the rolls speed of advance of the conveying apparatus, and the rolls speed of delivery of said upstream cutting machine;

wherein said centralised control unit (39) provides for commanding the working speed of the downstream utilisation to suit it to the advancement requirements of the advancing line (15), wherein, said rolls are paper tissue rolls.

39. Apparatus for conveying items in the form of substantially cylindrical rolls (P, 16) having a longitudinal axis (L) and extreme transverse faces in a system for producing and packing said rolls comprising an upstream working machine (12), at least a downstream working machine (14', 14") for packing said rolls, and a conveying apparatus between said upstream working machine (12) and said downstream working machine (14', 14"); the conveying apparatus including a control unit (39) controlling the rolls speed of advance of the conveying apparatus, and the rolls speed of delivery of said upstream cutting machine;

said control means providing for setting and adjusting the speed of advance of the conveyor belts of the conveying apparatus of the conveying line in accordance with the speed of advance of the stick within the upstream cutting machine, wherein, said rolls are paper tissue rolls.

40. Apparatus for conveying items in the form of substantially cylindrical rolls (P, 16) having a longitudinal axis (L) and extreme transverse faces in a system for producing and packing said rolls comprising an upstream working machine (12), at least a first and a second downstream working machines (14', 14") for packing said rolls, and a conveying apparatus between said upstream working machine (12) and said downstream working machines (14', 14"); said conveying apparatus having movable conveying means (34) which are commanded to be positioned in correspondence of a first (30) or a second (32) conveying units for distributing said rolls towards corresponding downstream packing machines (14, 14"); the conveying apparatus including a control unit (39) for controlling the rolls speed of advance of the conveying apparatus, and the rolls speed of delivery of said upstream cutting machine;

wherein said centralised control unit (39) provides for commanding the actuation of said movable conveying means starting from data coming from the conveying system and from the packing machines, and said rolls are paper tissue rolls.

41. Apparatus for conveying items in the form of substantially cylindrical rolls (P, 16) having a longitudinal axis (L) and extreme transverse faces in a system for producing and packing said rolls comprising an upstream working machine (12), at least a downstream working machine (14', 14") for packing said rolls, and a conveying apparatus between said upstream working machine (12) and said downstream working machine (14', 14"); wherein between said upstream machine (12) and said downstream machine (14) the conveying apparatus comprises a plurality of conveying sections (21, 35, 37, 27, 28, 23, 24) longitudinally advancing said items (16), and wherein, in order to carry longitudinally said items (16) from said upstream machine (12) to said downstream machine (14), said items are advanced in longitudinal groups or trains of items; the conveying apparatus including a control unit (39) for controlling the rolls speed of advance of the conveying apparatus, and the rolls speed of delivery of said upstream cutting machine;

wherein said centralised control unit (39) provides that the speed of advance of the items (16) in each conveying section (21, 35, 37, 27, 28, 23, 24) is varied only after one or more groups or trains of items have been loaded onto said section (21, 35, 37, 27, 28, 23, 24), and said rolls are paper tissue rolls.

42. Apparatus for conveying items in the form of substantially cylindrical rolls (P, 16) having a longitudinal axis (L) and extreme transverse faces in a system for producing and packing said rolls comprising an upstream working machine (12), at least first and second downstream working machines (14', 14") for packing said rolls, and a conveying apparatus between said upstream working machine (12) and said first and second downstream working machines (14', 14"), wherein the conveying apparatus has lateral guiding means for said items are provided, said guiding means comprising opposite longitudinal portions (42, 44) for the lateral engagement of said rolls (16), wherein said guiding portions (42, 44) are situated in a position to contact the rolls underneath the centreline (L) of the same rolls (16), wherein, said rolls are paper tissue rolls, and wherein the rolls are conveyed at 10–40 meters per minute.

* * * * *